United States Patent [19]

Burns

[11] Patent Number: 4,492,939

[45] Date of Patent: Jan. 8, 1985

[54] PLANAR, QUADRATURE MICROWAVE COUPLER

[75] Inventor: John W. Burns, Middlesex, England

[73] Assignee: The Marconi Company Limited, England

[21] Appl. No.: 445,955

[22] Filed: Dec. 1, 1982

[30] Foreign Application Priority Data

Dec. 2, 1981 [GB] United Kingdom ..... 8136362

[51] Int. Cl.[3] ..... H01P 5/18

[52] U.S. Cl. ..... 333/116; 333/120; 333/238

[58] Field of Search ..... 333/116, 117, 120, 128, 333/238, 246, 136

[56] References Cited

U.S. PATENT DOCUMENTS 3,040,275 6/1962 Saad .
3,619,787 11/1971 Salzberg .
3,639,857 2/1972 Okoshi et al. ..... 333/238 X

FOREIGN PATENT DOCUMENTS 127260 10/1979 Japan .
1288943 9/1972 United Kingdom .
1605120 12/1981 United Kingdom .

OTHER PUBLICATIONS

Okoshi et al., *The Segmentation Method–An Approach to the Analysis of Microwave Planar Circuits,* IEEE Trans. on MTT-24, No. 10, Oct. 1976, pp. 662–668.

Okoshi et al., *The Planar Circuit–An Approach to Microwave Integrated Circuitry,* IEEE Trans. on MTT-20, No. 4, Apr. 1972, pp. 245–252.

Okoshi et al., *Computer-Oriented Synthesis of Optimum Circuit Pattern of 3-db Hybrid Ring by the Planar Circuit Approach,* IEEE Trans. on MTT-29, No. 3, Mar. 1981, pp. 194–202.

*Primary Examiner*—Paul Gensler

*Attorney, Agent, or Firm*—Kirschstein, Kirschstein, Ottinger & Israel

[57] ABSTRACT

A microwave coupler device of planar circuit form, similar in form to a conventional branch arm coupler in that it comprises a substrate (23) having a ground plane conductor on one main face and an electrically conductive pattern on the other main face comprising a central portion (25) and four strip portions (27, 29, 31, 33) extending therefrom, but in which the central portion, instead of comprising four limbs in a rectangular configuration, is in the form of a rectangle with the strip portions extending from positions adjacent the corners of the rectangle.

1 Claim, 2 Drawing Figures

PLANAR, QUADRATURE MICROWAVE COUPLER

This invention relates to microwave coupler devices.

BACKGROUND OF THE INVENTION (1) Field of the Invention

More particularly the invention relates to microwave coupler devices of planar circuit form for splitting an input signal into two, equal amplitude, quadrature outputs.

(2) Description of Related Art

One such device, known as a branch arm coupler, is shown in FIG. 1 of the accompanying drawings which is a plan view of the coupler.

The coupler is formed on a thin planar substate 1 of dielectric material. On one side, the underside as shown in FIG. 1, the substrate 1 is provided with an electrically conductive coating (not shown) which serves as a ground plane. On the other side of the substrate there is an electrically conductive pattern comprising four limbs 3, 5, 7 and 9 disposed in rectangular configuration.

The input to the coupler is applied between the ground plane and a conductive strip 11 extending from one corner of the limb pattern. A dummy load 13 is connected between the ground plane and a second conductive strip 15 extending from an adjacent corner of the limb pattern. Two outputs are derived respectively from between the ground plane and third and fourth conductive strips 17 and 19 extending respectively from the other two corners of the limb pattern.

The widths and lengths of the limbs 3, 5, 7 and 9 are chosen in conjunction with the thickness and the material of the substrate so that each of one pair of opposite limbs 3 and 7 constitutes, with the ground plane, a transmission line having a desired characteristic impedance Zo and a length equal to a quarter wavelength at the centre of the frequency band over which the coupler is required to operate, and each of the other two limbs 5 and 9 constitutes with the ground plane a similar transmission line, but of characteristic impedance $Zo/\sqrt{2}$. Similarly, each of the strips 11, 15, 17 and 19 forms with the ground plane a transmission line of characteristic impedance Zo, and the dummy load 13 has an impedance Zo.

In operation the coupler splits an applied input signal A into two equal amplitude quadrature outputs $-A$ and $-jA$ which appear at the outputs constituted by strip portions 17 and 19 respectively and the ground plane. Such a coupler finds application, for example, in balanced mixers and comparator circuitry.

One problem which arises in the design of such a coupler is that the gap 21 between the limbs 3, 5, 7 and 9 becomes excessively small at millimetric wave frequencies, especially if a substrate of relatively low permittivity material is used, giving rise to undesired cross-coupling and consequent degradation of performance.

SUMMARY OF THE INVENTION (1) Features of the Invention

It is an object of the present invention to provide a microwave coupler device of planar circuit form suitable for use in millimetric microwave circuits for splitting an input signal into equal amplitude quadrature outputs wherein this problem is overcome.

BRIEF DESCRIPTION OF THE INVENTION

According to the present invention there is provided a microwave coupler device comprising: a substrate of dielectric material; a ground plane conductor on one main face of the substrate; and an electrically conductive pattern on the other main face of the substrate comprising a central portion in the form of a rectangle and four strip portions respectively extending from positions adjacent the corners of the rectangle, the arrangement being such that with a dummy load connected between a first strip portion and the ground plane conductor, an input signal applied between an adjacent second strip portion and the ground plane conductor produces substantially equal amplitude, quadrature outputs between the third and fourth strip portions respectively and the ground plane conductor.

Preferably the dimension of the rectangle between its side extending between the first and second strip portions and its opposite side is greater than the dimension of the rectangle between its other pair of opposite sides, and the strip portions extend from positions at the ends of the longer sides of the rectangle. In such an arrangement the sides of the strip portions are preferably at substantially 45° to the sides of the rectangle.

DETAILED DESCRIPTION OF THE INVENTION

Figure 1:
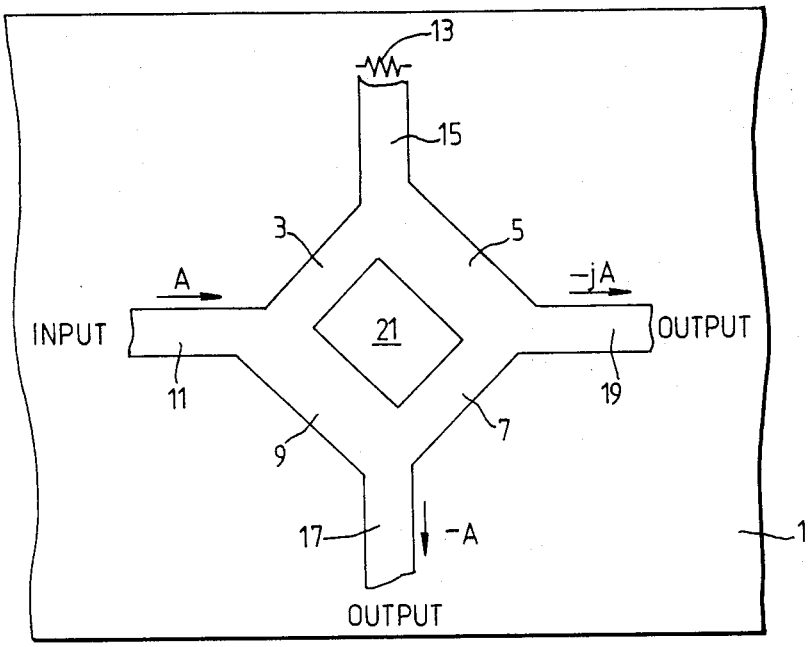
Fig.1 PRIOR ART
FIG. 1 is a plan view of a prior art branch arm coupler.

The device is formed on a quartz substrate 23 one side of which is provided with a coating of gold (not shown) which serves as a ground plane. On the other side of the substrate, shown uppermost in FIG. 2, there is a gold coating pattern comprising a central portion 25 in the form of a rectangle from each corner of which there extends a narrow strip portion 27, 29, 31 and 33, each strip forming with the ground plane a transmission line of characteristic impedance Zo.

In use, a dummy load 35 of value Zo is connected between the ground plane and one of the strips, say 29. In operation, an input signal B applied between the adjacent strip 27 and the ground plane gives rise to equal amplitude quadrature outputs $-B$ and $-jB$ between the strips 31 and 33 respectively and the ground plane.

Figure 2:
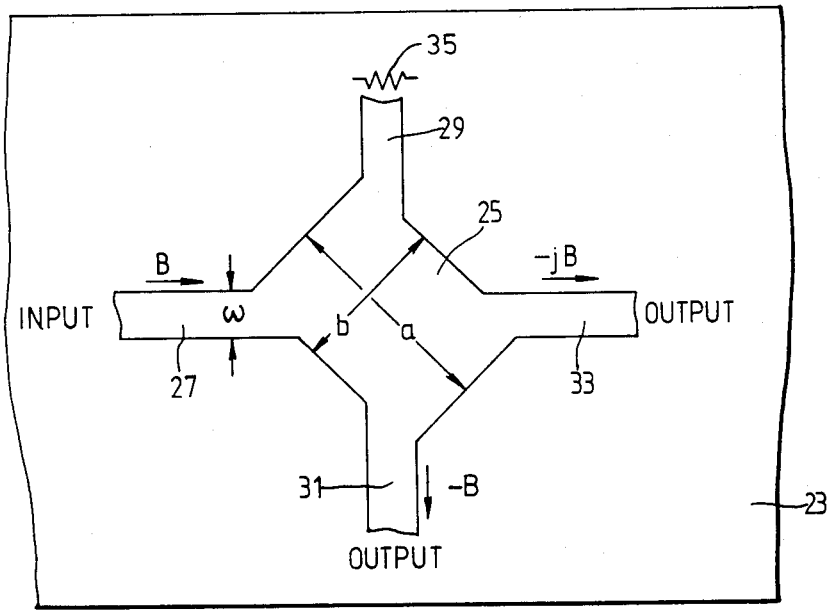
FIG. 2 is a plan view of a branch arm coupler embodying the present invention.

As will be seen, the device of FIG. 2 is essentially of the same form as a branch arm coupler, such as is illustrated in FIG. 1, but with the gap 21 omitted. Somewhat surprisingly however, the device operates satisfactorily and indeed is superior to a branch arm coupler at millimetric wave frequencies in that its sensitivity to frequency and circuit dimensions is reduced i.e. a greater bandwidth is obtainable. Moreover, since there are fewer dimensions involved, circuit design is simpler and quicker.

As illustrated in FIG. 2, the dimension a of the rectangular portion 25 between its side extending between the strips 27 and 29 to which the input and dummy load are respectively connected and its opposite side is preferably greater that the dimension b of the rectangular portion between its other pair of opposite sides. Furthermore, the strip portions 27, 29, 31 and 33 preferably extend from the rectangular portion 25 at positions at the ends of the longer sides of the rectangular portion, and in directions such that the sides of the strip portions are at 45° to the sides of the rectangular portion.

It has been found that at least for devices for use in circuits of characteristic impedance in the region of 50 ohms the dimensions a and b are preferably related by the equation $$a=b+w\sqrt{2}$$

where w is the width of the strips 27, 29, 31 and 33 and that $$b=0.46\ \lambda g$$

where λg is the wavelength of a signal at the centre of the frequency band over which the coupler is required to operate in a transmission line formed by a strip 27, 29, 31 or 33, with the ground plane.

In one particular device as shown in FIG. 2 designed for operation at a centre frequency of 94 GHz in a 50 ohm microstrip circuit fabricated on a Z-cut quartz substrate of thickness 120 microns and dielectric constant 4.4, the dimensions a, b and w are 1.13 millimeters, 0.78 millimeters and 0.25 millimeters respectively.

With these dimensions, typical performance figures for the device are as follows: at 94 GHz:

| | |
|---|---|
| Transmission loss between input and either output | 3.5 dB |
| Isolation between input and dummy load | 26 dB |
| Return loss (input and outputs) | 18 dB |

and over a bandwidth of 13% isolation between input and dummy load is found to remain greater than or equal to 20 dB and the transmission losses to the two outputs to be within 0.5 dB of one another.

It will be appreciated that whilst the particular coupler device described above by way of example is designed for use in a microwave planar circuit of microstrip form, other coupler devices in accordance with the invention may be designed for use in microwave planar circuits of other forms, for example, Triplate circuit when the electrically conductive pattern will be sandwiched between two dielectric substrates each having a ground plane conductor on its face remote from the electrically conductive pattern.

I claim:

1. A microwave coupler device comprising: a substrate of dielectric material; a ground plane conductor on one main face of the substrate; and an electrically conductive pattern on the other main face of the substrate comprising a central portion in the form of a rectangle and four strip portions respectively extending from positions adjacent the corners of the rectangle, the strip portions being of equal widths, the dimension of the rectangle between its side extending between a first strip portion and an adjacent second strip portion and its opposite side exceeding the dimension of the rectangle between its other pair of opposite sides by substantially $\sqrt{2}$ times the width of the strip portions, the dimension of the rectangle between said other pair of opposite sides being substantially 0.46 times the wavelength of signals at the centre of the frequency band over which the coupler is required to operate in a transmission line formed by a said strip portion and the ground plane conductor, and the strip portions extending from positions at the ends of the longer sides of the rectangle with the sides of the strip portions at substantially 45° to the sides of the rectangle, the arrangement being such that with a dummy load connected between said first strip portion and the ground plane conductor, and input signal applied between said adjacent second strip portion and the ground plane conductor produces substantially equal amplitude, quadrature outputs between the third and fourth strip portions respectively and the ground plane conductor.

* * * * *